US005078591A

United States Patent [19]

Despres

[11] Patent Number: 5,078,591

[45] Date of Patent: Jan. 7, 1992

[54] CANDLE HAVING THERMAL RESPONSE

[76] Inventor: Roger J. Despres, 3700 S. Plaza Dr. #KPH12, Santa Ana, Calif. 92704

[21] Appl. No.: 684,842

[22] Filed: Apr. 15, 1991

[51] Int. Cl.[5] ..... F23N 5/00

[52] U.S. Cl. ..... 431/75; 431/288; 431/289

[58] Field of Search ..... 431/288, 289, 279, 75

[56] References Cited

U.S. PATENT DOCUMENTS 3,730,674 5/1973 Gross ..... 431/288

*Primary Examiner*—Carroll B. Dority
*Attorney, Agent, or Firm*—Roy A. Ekstrand

[57] ABSTRACT

A candle includes a candle body formed of a quantity of candle wax. In one embodiment, a stationary wick is embedded within the candle body and a movable wick is supported within the candle body by a bimetallic coil spring. The heat produced by the burning of the movable and stationary wicks causes a relative motion between the movable wick and the stationary wick. In an alternate embodiment a pair of movable wicks are supported by a pair of bimetallic coil springs such that the heat produced by the burning wicks causes the coil springs to join the movable wicks to produce a combined flame. In a still further alternate embodiment, a pair of bimetallic coil springs and a central wick are supported within a candle body. A pair of upwardly extending arms are coupled to the bimetallic coil springs and support a corresponding pair of heart-shaped members. The heat produced by the central candle wick is operative upon the bimetallic coil springs to cause the heart-shaped members to be joined as the candle burns.

24 Claims, 2 Drawing Sheets

CANDLE HAVING THERMAL RESPONSE

FIELD OF THE INVENTION

This invention relates generally to candles and particularly to those of the type which provides an amusing or entertaining feature.

BACKGROUND OF THE INVENTION

Since their earliest use, candles have provided a convenient and generally reliable source of light for mankind. While candles have varied substantially through the years, all generally comprise a solid fuel member (usually wax) within which a fiber wick is embedded. In their basic function, candles provide light once the fiber wick has been lighted by producing sufficient heat to melt the wax fuel to a liquid form which may be carried within the wick and burned. As the candle flame burns, the heat produced creates a pool of melted wax in the region of the wick. This liquified or melted wax is then carried up to the flame by capillary action within the wick. As the candle burns, and the wax fuel is consumed, the position of the flame moves downwardly upon the wick permitting the candle to produce a substantially continuous light.

In addition to providing a basic device which supplies light for the user, candles have found use in ceremonial and ritual activities in which substantial importance and significance is attached to the burning candle flame and its action. In addition, candles have been formed in a variety of colorful and decorative shapes and configurations to further increase their value and use. Further changes which have been provided have included the provision of various scented waxes by which the burning candle flame produces not only light but pleasant fragrance as well.

The continuing desire for evermore interesting and varied candles has prompted practitioners in the art to develop a variety of candles having added features.

For example, U.S. Pat. No. 3,730,674 issued to Gross sets forth a CANDLE having a wick embedded within a wax candle body. The wick is formed to have a memory characteristic by which it tends to return to its previous shape prior to be embedded within the candle body. A variety of candles are provided all enjoying the basic characteristic by which the melting action of the candle flame and wick upon the captivating wax body frees up the portion of the wick within the melted wax pool to permit the wick to move within the wax pool. As the candle melts the wax pool near the base of the wick, the flame position is moved with respect to the candle body due to the movement of the wick.

U.S. Pat. No. 4,555,231 issued to Kustka sets forth a UNITY CANDLE which includes two separate half-sections each having separate wicks on adjoining surfaces thereof. As the half sections are moved into registered engagement, the flames from the separate wicks are merged into a single flame of increased size and intensity which melts the wax of the candle to fuse the half sections together. Alternate embodiments are shown in which three candle sections may be joined by similar registered engagement and the melting action of the three individual wicks.

U.S. Pat. No. 4,797,090 issued to Rogers sets forth a CANDLE LANTERN APPARATUS which includes a supporting base structure within a lantern together with a spirally shaped candle. The spirally shaped candle is pivotally supported by the base. As the spiral candle is burned and consumed, the candle revolves with respect to the base due to the force of gravity and its freely pivotable attachment to maintain the candle flame at a substantially constant elevation.

U.S. Pat. No. 4,818,214 issued to Ronnback sets forth a DEVICE FOR EXTINGUISHING THE FLAME OF A CANDLE in which a burning candle is provided with a sleeve encircling the candle body at the desired extinguishing position of the candle. The sleeve is formed of a heat shrinkable plastic material. As the candle flame burns down to the region supporting the heat shrinkable plastic sleeve, the heat produced by the candle flame shrinks the plastic sleeve causing it to constrict about the candle flame and extinguish the candle flame.

U.S. Pat. No. 4,244,140 issued to Kim set forth TOYS WHICH SHAPE MEMORY ALLOYS in which a toy is formed of a center member having shape member and a surrounding covering. Thermal energy applied to the toy causes it to return to its predetermined shape.

U.S. Pat. No. 3,285,470 issued to Frei, et al. sets forth THERMALLY ACTUATED DEVICES having a variety of configurations in which a displacement or motion is provided through a mechanical action in response to heat energy.

While the foregoing described prior art devices have increased the amusement and enjoyment aspects of many candles, there remains a continuing need in the art for evermore interesting and enjoyable candle devices.

SUMMARY OF THE INVENTION

Accordingly, it is a general object of the present invention to provide an improved more interesting candle. It is a more particular object of the present invention to provide an improved more interesting candle in which the heat produced by the candle flame is used in a novel and interesting manner.

In accordance with the present invention, there is provided a candle comprises: a candle body; first and second candle wicks; first and second support means for supporting the first and second candle wicks respectively; and heat responsive means operative upon the first support means to move the first candle wick toward the second candle wick as the first and second candle wicks burn.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figures 1, 2, 3, 4:
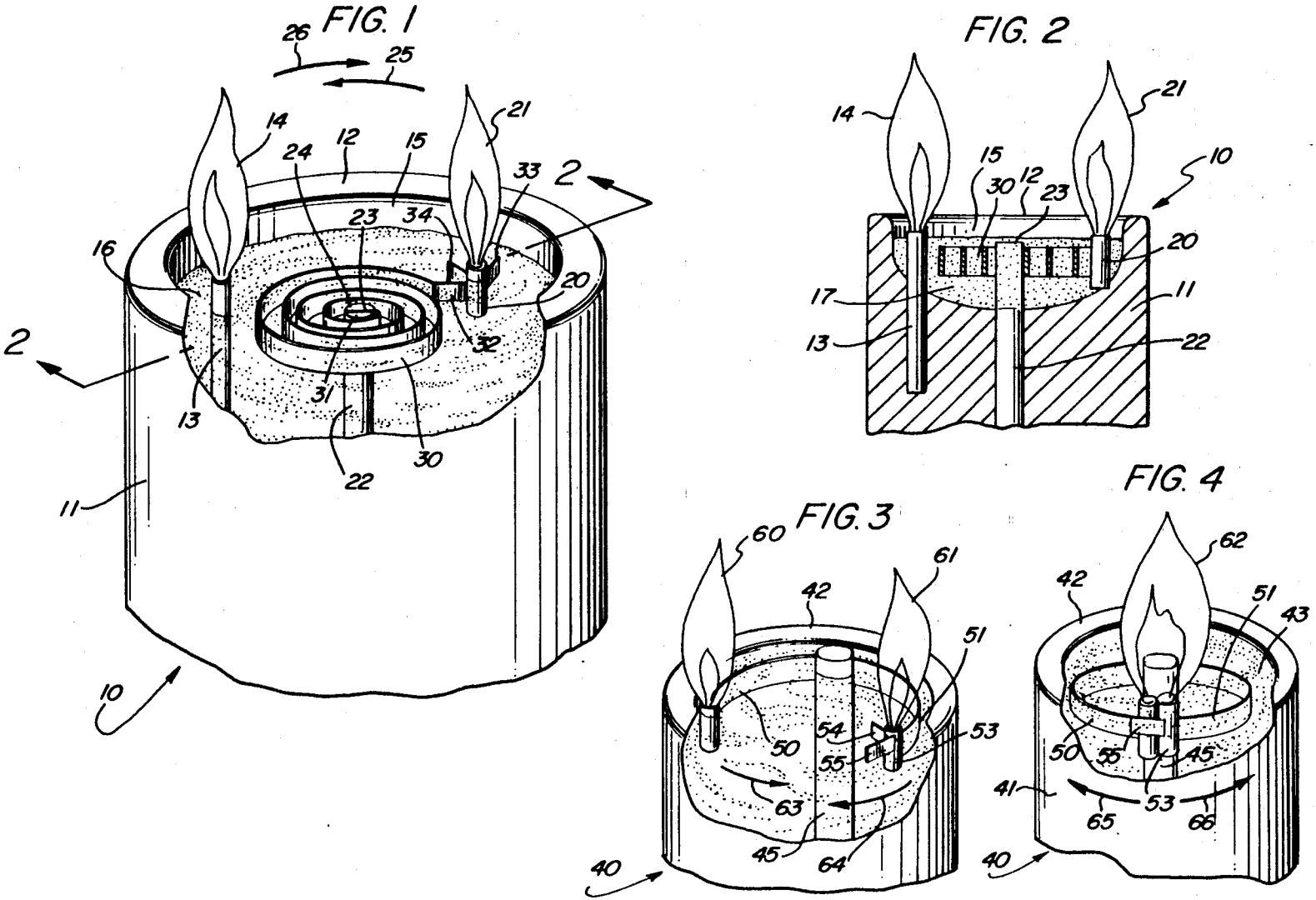
FIG. 1 sets forth a partially sectioned perspective view of a candle constructed in accordance with the present invention.
FIG. 2 sets forth a section view of the present invention candle shown in FIG. 1 taken along section lines 2—2 in FIG. 1.
FIG. 3 sets forth an alternate embodiment of the present invention candle in its cooled position.
FIG. 4 sets forth a perspective view of the alternate embodiment of FIG. 3 in the heated condition.

FIG. 1 sets forth a partially sectioned perspective view of a candle constructed in accordance with the present invention and generally referenced by numeral 10. Candle 10 includes a generally cylindrical candle body 11 preferably formed of a conventional candle wax material. Candle body 11 further defines an end portion 12 and means (not shown) providing a conventional candle support by which candle body 11 is maintained in a vertical position. A stationary wick 13 is embedded within candle body 11 and produces a stationary flame 14. An elongated support member 22 is embedded within candle body 11 and supported therein. Support member 22 defines an end portion 23 and a transverse slot 24. A bimetallic coil spring 30 defines an end portion 31 received within slot 24 of support member 22 to secure bimetallic coil spring 30 to support member 22 in a general horizontal position. Bimetallic spring 30 further defines a free end 32 extending radially from bimetallic spring 30. A movable candle wick 20 is secured to and supported by end 32 of bimetallic coil spring 30. Movable wick 20 produces a movable flame 21. A pair of angled guide members 33 and 34 extend outwardly from movable wick 20 in a diverging tapered alignment. While the position of wick 13, support 22, spring 30, and wick 20 within candle body 11 is, to a large extent a matter of design choice, it has been found to be advantageous to locate wick 13, support 22, spring 30 and wick 20 slightly off center to avoid melting the outer wall of candle body 11 surrounding the wax pool within recess 15.

In the embodiment shown in FIG. 1, bimetallic coil spring 30 is constructed such that the coils thereof expand when coil spring 30 is heated which moves movable wick 20 in the direction indicated by arrow 25 along a generally arced path towards stationary flame 14. Conversely, as bimetallic coil spring 30 is cooled, the coils thereof contract or tighten moving movable wick 20 in the direction indicated by arrow 26 which is away from stationary wick 13. It will be apparent to those skilled in the art, however, that spring 30 may alternatively be constructed such that it contracts when heated and expands when cooled.

In addition, the heat produced by movable flame 21 and stationary flame 14 cause the adjacent portions of candle body 11 near end portion 12 to melt in accordance with the typical candle flame action which forms a pool of liquified or melted wax material in the regions of stationary wick 13 and movable wick 20. As the liquified wax at end 12 of candle body 11 is consumed by the burning of wicks 13 and 20, a downwardly tapered recess 15 is formed at end 12 of candle body 11.

In operation, candle 10 is initially activated by lighting stationary wick 13 and movable wick 20 using any convenient lighting mechanism. At the time stationary wick 13 and movable wick 20 are initially lighted, the pool of candle wax within recess 15 which surrounds and permeates bimetallic coil spring 30 has cooled and solidified to form solid wax. Thereafter, the heat produced by stationary flame 14 and movable flame 21 causes the wax within recess 15 of candle body 11 to begin melting. As heat is initially created by flames 14 and 21, the solidified candle wax which captivates coil spring 30 precludes any motion of movable wick 20. Thus, for a period of time following the lighting of wicks 13 and 20, candle 10 remains in the position shown in FIG. 1. As the heat produced by flames 14 and 21 continues to heat and melt the candle wax within recess 15 however, the wax surrounding bimetallic coil spring 30 also melts. In addition, the melting of the candle wax within recess 15 couples a portion of the heat energy from candle flames 14 and 21 to bimetallic coil spring 30. In response to the heat energy within the melted wax in recess 15, coil spring 30 begins expanding which in turn moves movable wick 20 along an arced path in the direction indicated by arrow 25. As the heating of the molten wax within recess 15 continues, the expansion of coil spring 30 causes continued motion of movable wick 20 in the direction of arrow 25 towards stationary wick 13. So long as flames 14 and 21 remain lighted, the increased heat continues this motion of movable wick 20 until stationary wick 13 is received between guides 33 and 34. Thereafter, guides 33 and 34 cooperate to guide movable wick 20 into alignment with stationary wick 13. Once movable wick 20 is aligned with and adjacent to stationary wick 13, stationary flame 14 and movable flame 21 combine to form an enlarged unified flame. The heat energy produced by the combined flame of juxtaposed wicks 13 and 20 continues to maintain the heated pool of candle wax within recess 15. This heat energy in turns maintains the expansion force of coil spring 30 and maintains movable wick 20 in contact with stationary wick 13. At some point, candle 10 may be extinguished by simply blowing out or otherwise extinguishing the combined flames of wicks 13 and 20. Once the flames of candle 10 have been extinguished, the pool of molten wax within recess 15 begins to cool. As the pool of molten wax cools, the temperature of coil spring 30 is reduced and coil spring 30 begins contracting which in turn pivots movable wick 20 in the direction indicated by arrow 26 away from stationary wick 13 allowing it to return to the position shown in FIG. 1. Thereafter, the previously molten wax within recess 15 further cools and eventually solidifies forming a solid wax impregnation which captivates bimetallic coil spring 30. The cycle may be repeated by again lighting stationary wick 13 and movable wick 20.

Thus, in accordance, with the present invention, candle 10 provides an enjoyable and amusing function in which the separate wicks are initially lighted and the user observes the slow movement of movable wick 20 into contact with stationary wick 13 forming a unified flame as a result. The process is repetitive and the joining and separation of stationary wick 13 and movable wick 20 may be cycled as many times as desired.

FIG. 2 sets forth a section view of candle 10 taken along section lines 2—2 in FIG. 1. As described above, candle 10 includes a generally cylindrical body 11 defining an end portion 12 and means (not shown) supporting candle 10 in a generally vertical alignment. A stationary wick 13 is embedded within candle body 11. A support member 22 is embedded within and supported by candle body 11 and defines an end portion 23. A bimetallic coil spring 30 is secured to end 23 of support 22. The remaining end of coil spring 30 supports a movable wick 20. Stationary wick 13 and movable wick 20 produce candle flames 14 and 21 during their burning operation.

A wax pool 17 is formed within recess 15 of candle body 11 in accordance with the above-described operation due to the heating provided by candle flames 14 and 21. While the depth of molten wax formed within wax pool 17 varies in response to the amount of heat and length of time, candles flames 14 and 21 burn. Suffice it to note that wax pool 17 forms a pool of wax within recess 15 which is repeatedly heated and melted during the times candle flames 14 and 21 burn and thereafter cooled and solidified during the times when candle flame burning is not present. In accordance with an important aspect of the present invention, it should be noted that wax pool 17 surrounds bimetallic coil spring 30. Thus, in the above-described operation of the present invention candle, the heated wax within wax pool 17 serves to communicate heat energy to coil spring 30 and bring about the above-described motion of movable wick 20. Conversely, the solidification of wax pool 17 forms a captivating impregnation of solid wax about coil spring 30 which precludes motion of movable wick 20. It should be noted that the alternate embodiments of the present invention set forth below continue to utilize a thermally responsive element such as a bimetallic spring within the candle wax pool to provide the desired motion of one or more movable candle wicks or candle elements.

FIG. 3 sets forth an alternate embodiment of the present invention candle generally referenced by numeral 40. Candle 40 includes a generally cylindrical candle body 41 formed of a conventional candle wax and defining an end portion 42. An elongated support member 45 is embedded within candle body 41 and extends upwardly into wax pool 44 formed within recess 43. A pair of curved bimetallic spring arms 50 and 51 extend outwardly from the upper portion of support member 45. Spring arm 50 supports a movable wick 52 while spring arm 51 supports a movable wick 53. Movable wick 53 in turn supports a pair of outwardly extending guide members 54 and 55.

In operation, candle 40 assumes the position shown in FIG. 3 in response to the extinguishing of wicks 52 and 53 and the above-described cooling of wax pool 44. Bimetallic spring arms 50 and 51 are configured such that they flex outwardly to the position shown in FIG. 3 when cooled and inwardly to the position shown in FIG. 4 when heated. Thus, in the cooled position shown in FIG. 3, movable wicks 52 and 53 are separated by a substantial difference on either side of support member 45. In addition, the wax within wax pool 44 has solidified to captivate spring arms 50 and 51 in the separated positions shown. The operation of candle 40 is initiated by lighting movable wicks 52 and 53 to produce candle flames 60 and 61 respectively. As flames 60 and 61 heat the wax within wax pool 44, the wax pool begins to melt and spring arms 50 and 51 are freed as the wax liquifies. In addition, the melting wax within wax pool 44 communicates heat to spring arms 50 and 51 causing them to coil inwardly in the directions indicated by arrows 63 and 64. As candle flames 60 and 61 continue to heat the molten wax within wax pool 44, spring arms 50 and 51 flex inwardly moving wicks 52 and 53 together in the direction indicated by arrows 63 and 64 respectively. As heat continues to be applied to spring arms 50 and 51, wicks 52 and 53 are brought into contact during which time guide members 54 and 55 guide wicks 52 and 53 into alignment. Once wicks 52 and 53 are moved into alignment and positioned in contact, flames 60 and 61 combine to form an enlarged unified flame and candle 40 assumes the position shown in FIG. 4.

With respect to FIG. 4, it should be noted that spring arms 50 and 51 continue to flex inwardly so long as candle flame 62 burns and heat is applied to wax pool 44. Once flame 62 is extinguished, the molten wax within wax pool 44 begins to cool and spring arms 50 and 51 flex outwardly separating wicks 52 and 53 and moving them apart in the directions indicated by arrows 65 and 66 respectively. As the wax within wax pool 44 continues to cool, the outward expansion of springs arms 50 and 51 continues until the wax within wax pool 44 solidifies and spring arms 50 and 51 have returned to the open position shown in FIG. 3.

Once again it should be noted that the above-described cycle of the embodiment of the present invention shown in FIGS. 3 and 4 is capable of repeated operation during which the individual candle flames of wicks 52 and 53 are joined in an entertaining process to form a unified higher intensity combined flame.

Figure 5:
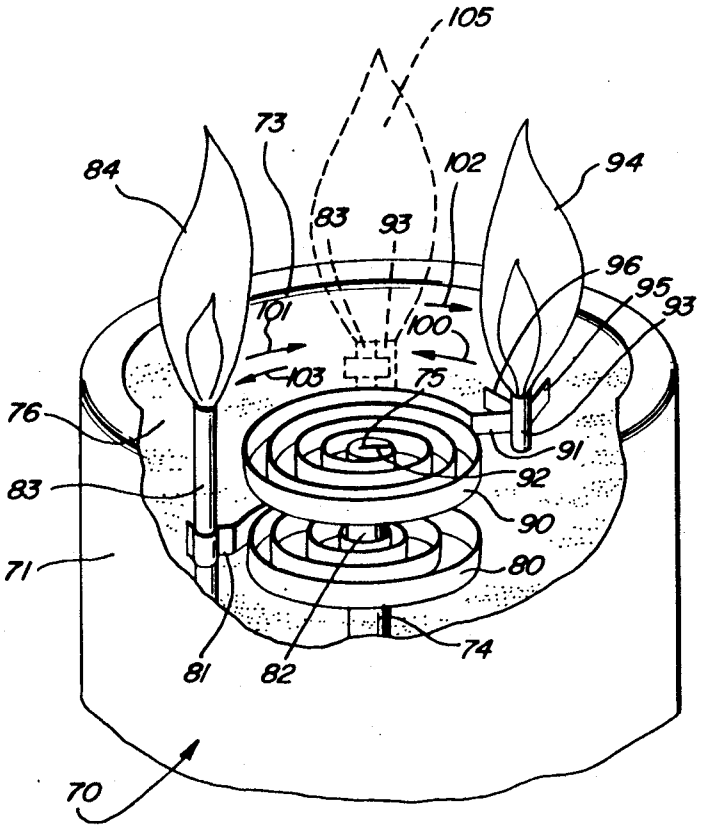
FIG. 5 sets forth a partially sectioned perspective view of a still further alternate embodiment of the present invention.

FIG. 5 sets forth a still further alternate embodiment of the present invention candle generally referenced by numeral 70. Candle 70 includes a generally cylindrical candle body 71 defining an end portion 72 and forming a recess 73. A wax pool 76 is formed within recess 73 in the above-described manner. An elongated support 74 is embedded within and supported by candle body 71 and defines an upper end 75 which is positioned within wax pool 76. A bimetallic coil spring 80 includes an end 82 which is secured to support 74 by conventional attachment means and an outwardly extending end 81. End 81 supports an upwardly extending movable wick 83. A bimetallic coil spring 90 includes an end portion 92 secured to end 75 of support 74 by a conventional attachment and an outwardly extending end 91. End 91 supports a movable wick 93 and a pair of angled guide members 95 and 96.

Coil spring 80 is formed having a thermal characteristic whereby the coils of spring 80 expand when heat causing end 81 and wick 83 to move in the direction indicated by arrow 101. Conversely, coil spring 80 contracts when cooled causing end 81 and wick 83 to move in the direction indicated by arrow 103 during cooling. Similarly, coil spring 90 is fabricated such that spring 90 expands when heated causing end 91 and wick 93 to move in the direction indicated by arrow 100 while cooling of coil spring 90 causes spring 90 to contract moving end 91 and wick 93 in the direction indicated by arrow 102. As mentioned above, a bimetallic spring may alternatively be fabricated which contracts when heated and expands when cooled without departing from the invention.

In the position shown in FIG. 5, wax pool 76 has been cooled and coil springs 80 and 90 have moved wicks 83 and 93 respectively to their separated positions shown in FIG. 5. As mentioned above, in the absence of candle flames, wax pool 76 solidifies to captivate coil springs 80 and 90. The operation of candle 70 is initiated by lighting wicks 83 and 93 to produce candle flames 84 and 94 respectively. Thereafter, the heat produced by flames 84 and 94 melts the candle wax within wax pool 76 and heats coil springs 80 and 90. The heating of springs 80 and 90 moves wicks 83 and 93 inwardly in the directions indicated by arrows 101 and 100 respectively until they are joined in the dashed line position shown and form a unified candle flame 105. The heat produced by flame 105 maintains wicks 83 and 93 in contact. Once flame 105 is extinguished, however, the wax within wax pool 76 begins to cool and coil springs 80 and 90 are correspondingly cooled causing wicks 83 and 93 to be moved outwardly in the directions indicated by arrows 103 and 102 respectively whereupon wicks 83 and 93 ultimately return to the open position shown in FIG. 5.

Figure 6:
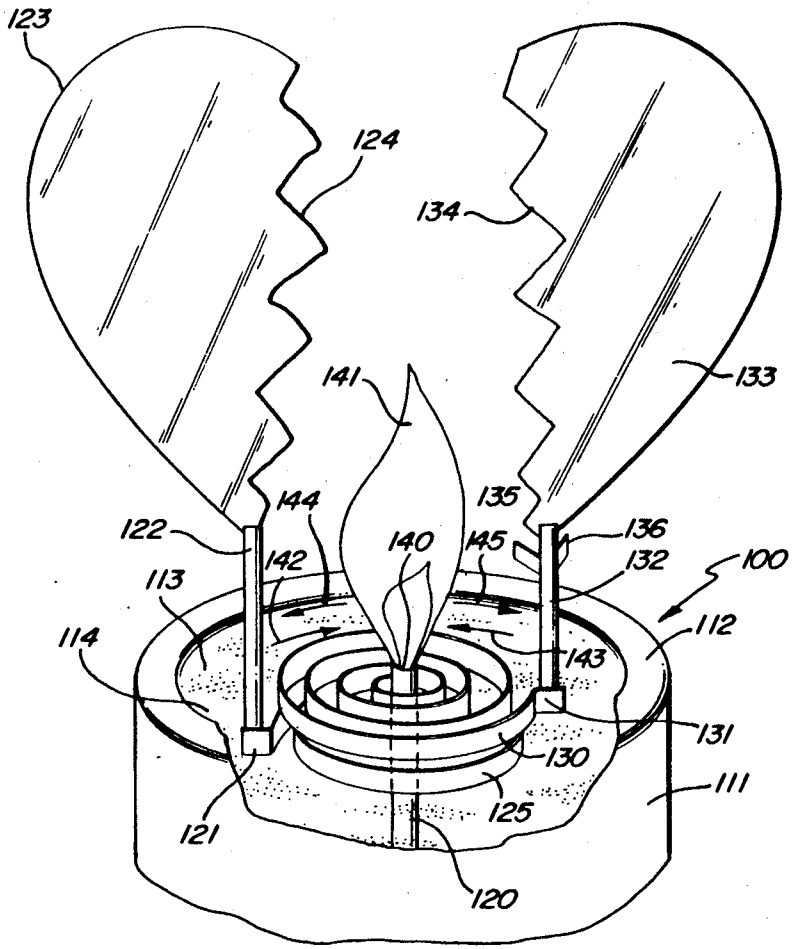
FIG. 6 sets forth a partially sectioned perspective view of a still further alternate embodiment of the present invention candle.

FIG. 6 sets forth a still further alternate embodiment of the present invention candle generally referenced by numeral 110. Candle 110 includes a generally cylindrical body 111 defining an end portion 112 and having formed a recess 113 therein. A wax pool 114 is formed within recess 113. An elongated support 120 is embedded within and supported by candle body 111. Support 120 includes an upwardly extending wick 140 which produces a candle flame 141. A coil spring 125 is secured to support 120 and defines an outwardly extending end portion 121. An arm 122 is supported by end 121 of spring 125 and extends upwardly therefrom. A heart-shaped portion 123 is secured to the upper end of arm 122 and defines a jagged edge 124. A coil spring 130 is secured to support 120 and defines an outwardly extending end 131. An upwardly extending arm 132 is supported by end 131 of spring 130. Arm 132 further supports a pair of angled guide members 135 and 136 and a heart-shaped portion 133. The latter defines a jagged edge 134.

In the position shown in FIG. 6, coil springs 125 and 130 have assumed their cooled positions causing arms 122 and 132 to be separated on either side of wick 140. In addition, the wax within wax pool 114 solidifies about coil springs 125 and 130 in the manner described below to maintain heart-shaped portions 123 and 133 in the separated position shown in FIG. 6.

The operation of candle 110 is initiated by lighting wick 140 to produce flame 141. The heat produced by flame 141 melts the wax within wax pool 114 and heats coil springs 125 and 130. In response to the heat applied to coil springs 125 and 130, end portions 121 and 131 respectively are moved in the converging directions indicated by arrows 142 and 143. This motion continues so long as candle flame 141 continues to burn providing heat for the molten wax within wax pool 114. As coil springs 125 and 130 continue to contract, arms 122 and 132 are brought into contact during which time guide members 135 and 136 cooperate to properly align arms 122 and 132 and bring heart-shaped portions 123 and 133 into contact. To enhance the aesthetic appeal and amusement value of candle 110, jagged edges 124 and 134 of heart-shaped portions 123 and 133 respectively are complimentary permitting heart-shaped portions 123 and 133 to form a completed heart-shaped member when joined. The joined positions of heart-shaped portions 123 and 133 are maintained so long as flame 141 continues to heat the wax within wax pool 114. In the event flame 141 is extinguished, the wax within wax pool 114 begins cooling and coil springs 125 and 130 are similarly cooled causing them to expand. The cooling action of springs 125 and 130 moves arms 122 and 132 apart in the directions indicated by arrows 144 and 145 respectively. This motion of arms 122 and 132 separate heart-shaped portions 123 and 133 respectively and returns candle 110 to the position shown in FIG. 6.

What has been shown is an improved candle which provides a response to the heat produced by one or more candle flames to increase the amusement and entertainment value of the candle. The entertaining action of the candle of the present invention is repeatable and is capable of performing for an indefinite number of cycles each time the candle flames are lighted and extinguished. It will be apparent to those skilled in the art that while the examples set forth herein have utilized a simple cylindrical candle body, the present invention embodiments are readily usable with virtually any shape of candle body without departing from the spirit and scope of the present invention. It will be further apparent to those skilled in the art that while the embodiments set forth herein provides for the joining and separation of a heart-shaped figure, other aesthetically pleasing and interrelated elements such as flags or the like may be similarly joined and separated by the present invention mechanism without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A candle comprising:
a candle body;
first and second candle wicks;
first and second wick support means for supporting said first and second candle wicks respectively; and
first heat responsive means operative upon said first wick support means to move said first candle wick toward said second candle wick as said first and second candle wicks burn.

2. A candle as set forth in claim 1 wherein said first heat responsive means includes a first attachment member coupled to said candle body.

3. A candle as set forth in claim 2 wherein said first heat responsive means includes a first thermally responsive member coupled between said first attachment member and said first wick support means, said first thermally responsive member having a first shape at lower temperatures and a second shape at higher temperatures.

4. A candle as set forth in claim 3 wherein said first thermally responsive member includes a first thermally responsive spring.

5. A candle as set forth in claim 4 wherein said first thermally responsive spring is formed of a coiled bimetallic element.

6. A candle as set forth in claim 3 wherein said candle body forms a concave recess as said first and second candle wicks burn and forms a pool of molten candle body material therein and wherein said first thermally responsive member is supported within said pool of molten candle body material.

7. A candle as set forth in claim 6 wherein said pool molten candle body material solidifies when said first and second candle wicks are extinguished and captivates said first thermally responsive member in its first shape.

8. A candle comprising:
a candle body;
first and second candle wicks;
first and second wick support means for supporting said first and second candle wicks respectively; and
first and second heat responsive means operative upon said first and second wick support means for moving said first and second candle wicks toward each other as said first and second candle wicks burn and to separate said first and second candle wicks after extinction thereof.

9. A candle as set forth in claim 8 wherein said first and second heat responsive means are coupled to said candle body.

10. A candle as set forth in claim 9 including an attachment member secured to said candle body wherein first and second heat responsive means includes first and second thermally responsive members coupled between said first attachment member and said first and second wick support means respectively, said first and second thermally responsive members each having a first shape at lower temperatures and a second shape at higher temperatures.

11. A candle as set forth in claim 10 wherein said first and second thermally responsive members include respective first and second thermally responsive springs.

12. A candle as set forth in claim 11 wherein said first and second thermally responsive springs are each formed of a coiled bimetallic element.

13. A candle as set forth in claim 10 wherein said candle body forms a concave recess as said first and second candle wicks burn and forms a pool of molten candle body material therein and wherein said first and second thermally responsive members are supported within said pool of molten candle body material.

14. A candle as set forth in claim 13 wherein said pool molten candle body material solidifies when said first and second candle wicks are extinguished and captivates said first and second thermally responsive members in their first shapes.

15. A candle as set forth in claim 11 wherein said first thermally responsive spring includes a generally C-shaped bimetallic spring secured to said first attachment member near its center and supporting said first and second candle wicks at its ends.

16. A candle as set forth in claim 15 wherein said first candle wick support means includes a pair of angled guide members extending radially outwardly from said first candle wick support means.

17. A candle as set forth in claim 5 wherein said first candle wick support means includes a pair of angled guide members extending radially outwardly from said first candle wick support means.

18. A candle comprising:

a candle body;

first and second visual elements;

a candle wick captivated within said candle body;

first and second support means for supporting said first and second visual elements respectively; and first and second heat responsive means operative upon said first and second support means to move said first and second visual elements toward each other as said candle wick burns.

19. A candle as set forth in claim 18 wherein said first and second heat responsive means include a first attachment member coupled to said candle body supporting said first and second heat responsive means thereupon.

20. A candle as set forth in claim 19 wherein first and second heat responsive means include first and second thermally responsive members coupled between said first attachment member and said first and second visual elements respectively, said first and second thermally responsive members each having a first shape at lower temperatures and a second shape at higher temperatures.

21. A candle as set forth in claim 20 wherein said first and second thermally responsive members includes first and second thermally responsive springs respectively.

22. A candle as set forth in claim 21 wherein said first and second thermally responsive springs are each formed of a coiled bimetallic element.

23. A candle as set forth in claim 22 wherein said candle body forms a concave recess as said candle wick burns and forms a pool of molten candle body material therein and wherein said first and second thermally responsive members are supported within said pool of molten candle body material.

24. A candle as set forth in claim 23 wherein said pool molten candle body material solidifies when said candle wick is extinguished and captivates said first and second thermally responsive members in their first shapes.

* * * * *